US011633643B2

(12) United States Patent
Leier et al.

(10) Patent No.: US 11,633,643 B2
(45) Date of Patent: Apr. 25, 2023

(54) METHODS OF ASSEMBLING EXERCISE APPARATUS

(71) Applicant: Expectations, LLC, Bonney Lake, WA (US)

(72) Inventors: Christopher H. Leier, Lake Tapps, WA (US); Nicholas M. Soller, Edgewood, WA (US)

(73) Assignee: Expectations, LLC, Bonney Lake, WA (US)

( * ) Notice: Subject to any disclaimer, the term of this patent is extended or adjusted under 35 U.S.C. 154(b) by 190 days.

(21) Appl. No.: 17/217,709

(22) Filed: Mar. 30, 2021

(65) Prior Publication Data

US 2021/0308518 A1 Oct. 7, 2021

Related U.S. Application Data

(60) Provisional application No. 63/003,481, filed on Apr. 1, 2020.

(51) Int. Cl.
*A63B 22/00* (2006.01)
*A63B 22/06* (2006.01)

(52) U.S. Cl.
CPC ..... *A63B 22/0076* (2013.01); *A63B 22/0664* (2013.01); *A63B 2022/0084* (2013.01); *A63B 2022/0676* (2013.01); *A63B 2210/58* (2013.01)

(58) Field of Classification Search
CPC ..... A63B 22/0087–0089; A63B 22/0664–2022/0688; A63B 22/208; A63B 69/04; A63B 69/06–2069/066; A63B 22/0015–0017; A63B 22/0046; A63B 23/035; A63B 23/03575
See application file for complete search history.

(56) References Cited

U.S. PATENT DOCUMENTS 5,836,855 A 11/1998 Eschenbach
7,141,008 B2 * 11/2006 Krull ..... A63B 69/06 482/70

(Continued)

*Primary Examiner* — Jennifer Robertson
(74) *Attorney, Agent, or Firm* — Dicke, Billig & Czaja, PLLC

(57) ABSTRACT

A rowing exercise apparatus has a linkage assembly that is provided in two boxes. One box includes a forward frame member, a crank rotatably mounted on the forward frame member, and a forward portion of a seat supporting link operatively connected to the crank. Another box includes a rearward frame member, a rocker link pivotally mounted on the rearward frame member, and a rearward portion of the seat supporting link operatively connected to the rocker link. The linkage assembly is made suitable for use by rigidly connecting the two frame members to one another and by rigidly connecting the two portions of the seat supporting link to one another. At least one bracket is rigidly interconnected between the two portions of the seat supporting link. One such bracket is welded onto a rearward end of the forward portion of the seat supporting link to underlie and directly support a proximate end of the rearward portion of the seat supporting link. A seat is mounted on the seat supporting link for movement through at least one elliptical path as the linkage assembly moves through cycles relative to the rigidly interconnected frame members.

10 Claims, 6 Drawing Sheets

(56) References Cited

U.S. PATENT DOCUMENTS

| | | | | |
|---|---|---|---|---|
| 7,500,938 | B2 * | 3/2009 | Fan | A63B 22/0076 482/95 |
| 10,518,126 | B1 | 12/2019 | Krull | |
| 2008/0200265 | A1 | 8/2008 | Chuang et al. | |
| 2008/0200267 | A1 | 8/2008 | Chuang et al. | |
| 2008/0200271 | A1 | 8/2008 | Chuang et al. | |

* cited by examiner

Fig. 4
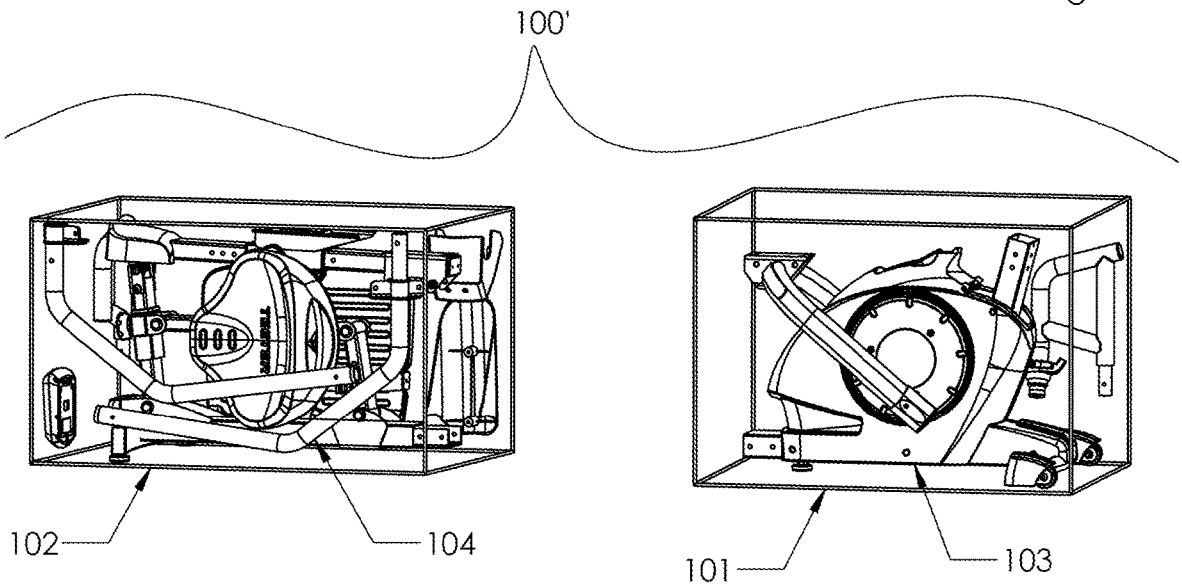
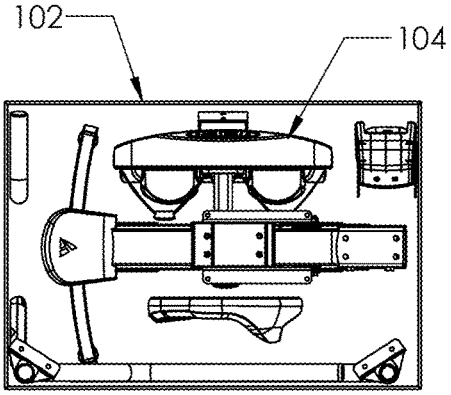
Fig. 5
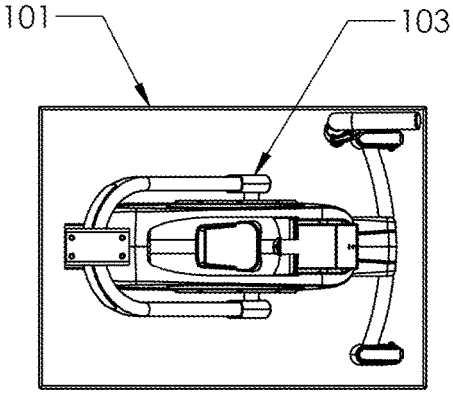
Fig. 6
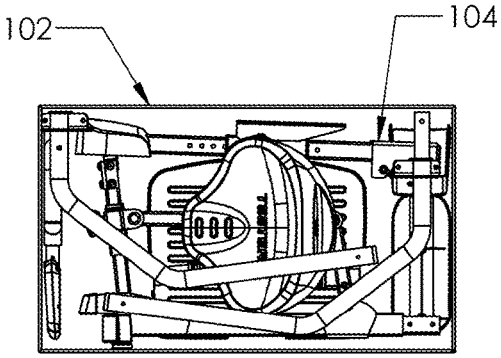
Fig. 7
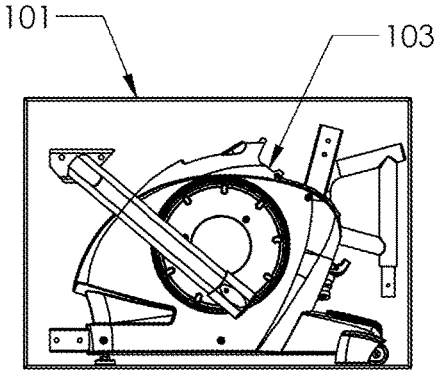
Fig. 8

METHODS OF ASSEMBLING EXERCISE APPARATUS

FIELD OF THE INVENTION

The present invention relates to methods for packaging, delivering, and/or assembling exercise apparatus, including elliptical rowing exercise equipment that supports a user on a seat for movement through an elliptical path.

BACKGROUND OF THE INVENTION

U.S. Pat. No. 7,141,008 to Krull et al. and U.S. Pat. No. 10,518,126 to Krull disclose certain embodiments of a particular type of exercise apparatus that may be described as an elliptical path rowing exercise machine. Generally speaking, such a machine includes a relatively long structural member that supports a user in a seated position for movement through at least one elliptical path relative to a support frame. On at least some embodiments, one end of the member is preferably connected to a crank rotatably mounted on the frame, while the other end of the member is preferably connected to a rocker link pivotally mounted on the frame. An object of the present invention is to provide new and improved methods and apparatus for shipping various elliptical rowing exercise machines in two separate boxes, including a first box that contains the front end of the frame, the crank, and a front portion of the structural member, and a second box that contains the rear end of the frame, the rocker link, and a rear portion of the structural member. A related objective is to ensure reliable and practical connections between the two frame portions and between the two portions of the structural member.

SUMMARY OF THE INVENTION

In one respect, the present invention may be described in terms of an exercise apparatus, comprising: a frame; a crank rotatably mounted on the frame for rotation about an axis, wherein the crank defines a crank member at a radial distance from the axis; a user support link movably interconnected between the crank member and the frame; and a seat mounted on the user support link for movement through at least one elliptical path in response to rotation of the crank. The link comprises separable first and second pieces that are rigidly interconnected by at least one bracket, and the frame comprises separable first and second pieces that are rigidly interconnected by at least one fastener, thereby accommodating shipment of one portion of the apparatus, including both first pieces, in a first box and shipment of a second portion of the apparatus, including both second pieces, in a second box.

On at least some embodiments, the first piece of the link is a generally U-shaped member having left and right end segments operatively connected to respective said left and right sides of the crank member, and a middle portion integrally interconnected between the left and right end segments. On such embodiments, the second piece is a beam having a first end movably linked to the frame and an opposite, second end. The at least one bracket is rigidly interconnected between the second end of the beam and the middle portion of the U-shaped member.

In another respect, the present invention may be described in terms of an improved elliptical rowing exercise apparatus of the type having (a) a frame; (b) a crank rotatably mounted on one end of the frame; (c) a rocker link pivotally mounted on an opposite end of the frame; (d) a rigid, user supporting member having a front portion that is operatively connected to the crank and an opposite, rear portion that is operatively connected to the rocker link; and (e) a seat mounted on the beam portion of the user supporting member. In this context, the improvement may be described as comprising a bracket rigidly mounted on top of a rearward end of the front portion to define an upwardly facing surface, wherein a forward end of the rear portion rests on top of the upwardly facing surface on the bracket and is rigidly secured thereto by at least one bolt.

In yet another respect, the present invention may be described in terms of a method of assembling an elliptical rowing exercise apparatus. One step of the method involves providing a first box containing a front frame portion, a crank rotatably mounted on the front frame portion, and a forward link member operatively connected to the crank, as well as a second box containing a rear frame portion, a rocker link pivotally mounted on the rear frame portion, and a rearward link member operatively connected to the rocker link. After the contents of each box are removed, the front frame portion is rigidly connected to the rear frame portion, and the forward link member is rigidly connected to the rearward frame member to define a user supporting member that includes a seat. In one preferred method, a bracket is rigidly mounted on top of the forward link member to define an upwardly facing surface, and the rearward link member is positioned on top of the upwardly facing surface on the bracket and rigidly secured thereto.

Various features of and/or applications for the present invention may become more readily apparent from the more detailed description that follows.

BRIEF DESCRIPTION OF THE DRAWING

With reference to the Figures of the Drawing, wherein like numerals represent like parts and assemblies throughout the several views:

FIG. 4 is a perspective view of the exercise apparatus of FIG. 1 partially disassembled and packaged inside separate first and second boxes;

FIG. 5 is a top view of the first box and its contents;

FIG. 6 is a top view of the second box and its contents;

FIG. 7 is a side view of the first box and its contents;

FIG. 8 is a side view of the second box and its contents;

DETAILED DESCRIPTION OF THE PREFERRED EMBODIMENT

Figure 1:
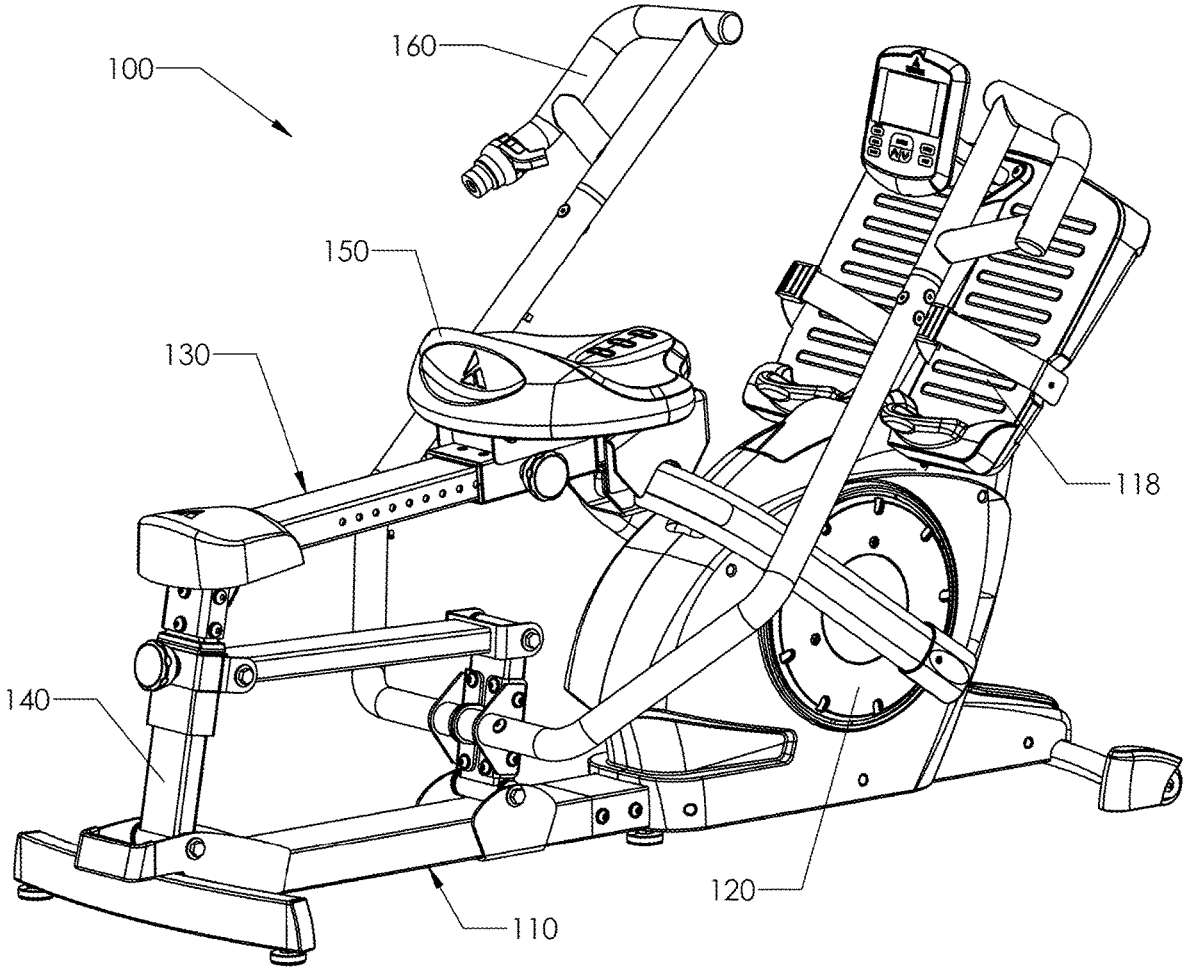
FIG. 1 is a perspective view of an exercise apparatus constructed according to the principles of the present invention.

A preferred embodiment exercise apparatus constructed according to the principles of the present invention is designated as 100 in FIG. 1. Generally speaking, the exercise apparatus 100 is functionally similar to the type of exercise apparatus disclosed in U.S. Pat. No. 7,141,008 to Krull et al., which is incorporated herein by reference. More specifically, the primary distinctions involve the manner in which the present invention is manufactured, packaged, shipped, and/or assembled. As a result, this disclosure will focus primarily on certain aspects of the apparatus 100 with the understanding that persons skilled in the art will glean other aspects and features of the subject invention from the above-identified patent together with the description that follows. Person skilled in the art will also recognize that the elements of the present invention may extend to other exercise apparatus, as well, including for example, those disclosed in U.S. Pat. No. 10,518,126 to Krull, which is also incorporated herein by reference.

Figure 3:
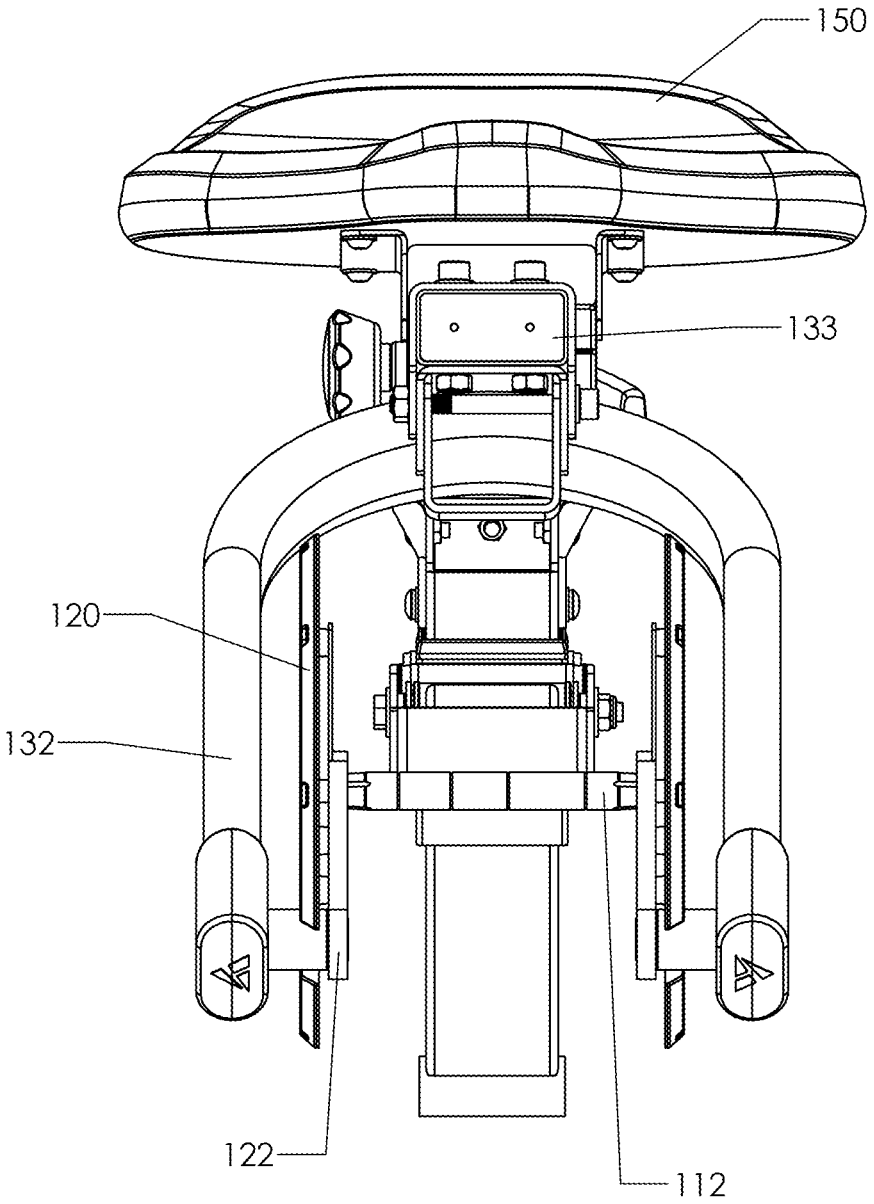
FIG. 3 is a front view of a linkage assembly on the exercise apparatus of FIG. 1.
Figure 9:
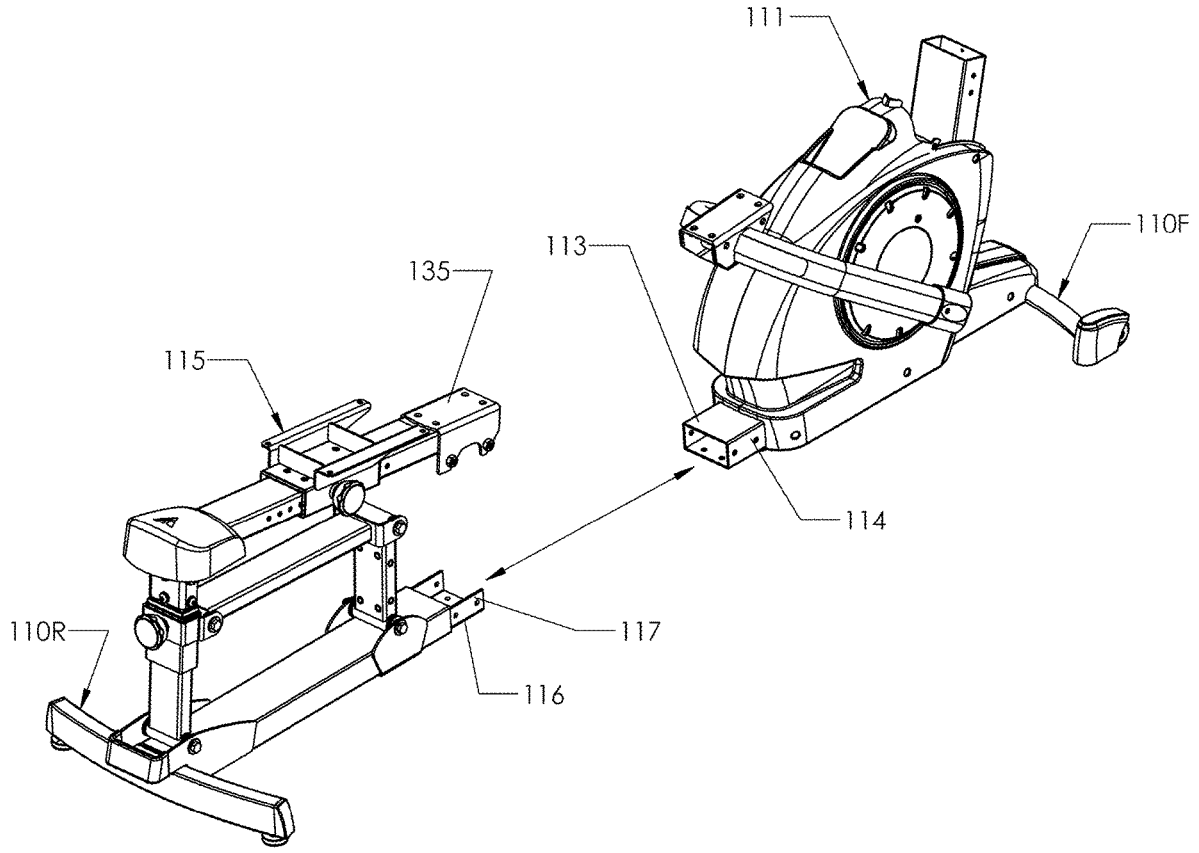
FIG. 9 is a perspective view showing how a sub-assembly from the first box aligns with a sub-assembly from the second box at a first area of connection.

The exercise apparatus 100 includes a frame 110 that is comprised of interconnected steel tubes and configured to occupy a stable operative position on an underlying floor surface. As shown in FIG. 9, the frame 110 includes a first or forward frame portion 110F and a second or rearward frame portion 110R, each of which is configured to occupy an upright position on an underlying floor surface. As shown in FIG. 1, a foot platform 118 is rigidly mounted on the forward portion 110F of the frame 110. FIG. 3 shows components of a linkage assembly apart from other components, including the frame 110. The linkage assembly of the exercise apparatus 100 includes a shaft 112 having a middle portion that is rotatably mounted on the frame 110, via conventional bearings or other known means, for rotation about an axis. The linkage assembly is symmetrical about a plane of symmetry extending perpendicularly through a midpoint of the shaft 112. Left and right crank arms 122 are rigidly secured to respective left and right ends of the shaft 112. The left and right crank arms 122 are mirror images of one another and extend a common radial distance in a common direction away from the shaft 112. Left and right crank covers 120 are rigidly mounted on respective left and right crank arms 122 to shroud the crank portion of the linkage assembly.

Figure 2:
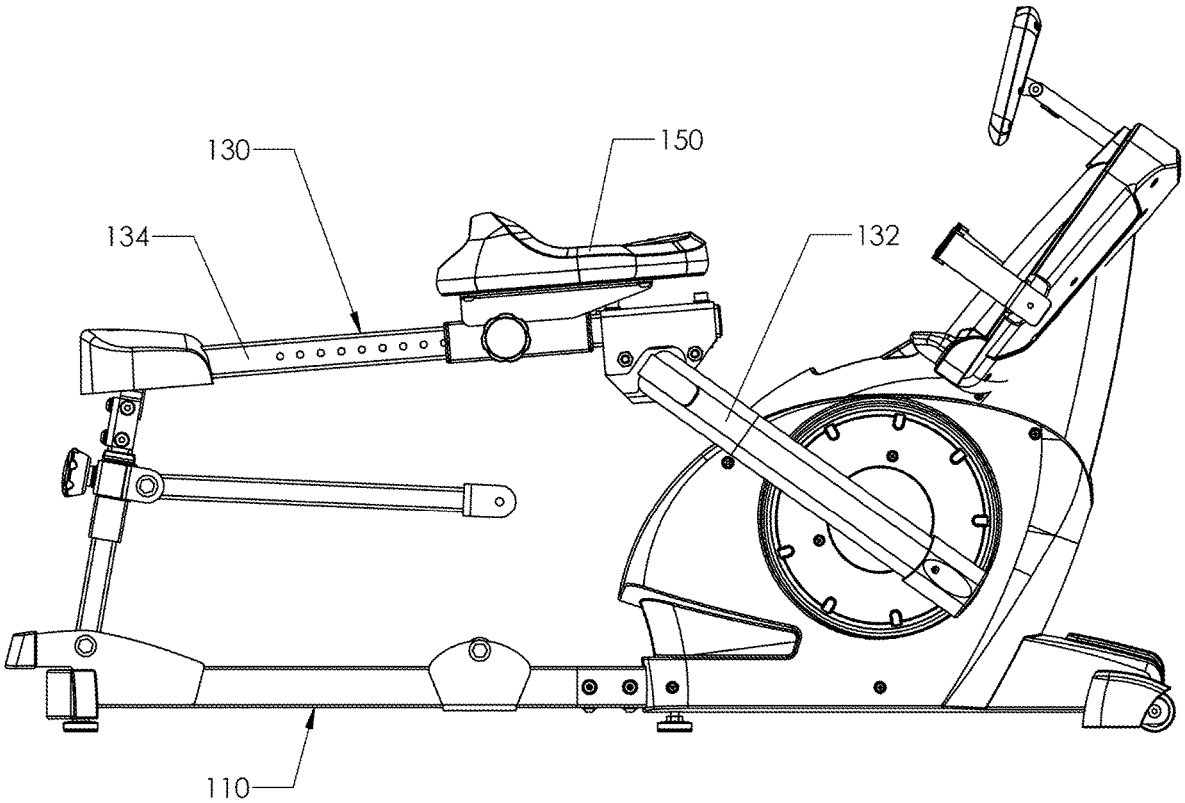
FIG. 2 is a side view of the exercise apparatus of FIG. 1, with a handlebar component removed to reveal other parts.

As shown in FIGS. 1 and 2, a structural member 130 includes a first or forward link member 132. On the preferred embodiment 100, the member 132 comprises a steel tube having an oval cross-section and bent into a U-shape. As such, the generally U-shaped link member 132 includes left and right ends or end segments, and a curved middle portion or middle segment extending therebetween. Each end of the U-shaped member 132 is rotatably connected to an outer end of a respective left or right crank arm 122. Persons skilled in the art will recognize that alternative embodiments of the present invention may include different crank arrangements, including, for example, a gap defined between interconnected left and right cranks to accommodate a centrally located, linear member therebetween (in lieu of the forked member 132).

The structural member 130 also includes a second or rearward link member 134. On the preferred embodiment 100, the rearward link member is a beam 134 comprising a steel tube having a rectangular cross-section and extending linearly. As such, the beam 134 has a first end and an opposite, second end. The second end overlies the middle portion of the U-shaped member 132, and is rigidly secured thereto by means of at least one bracket, as further described below. A metal plug and/or cap 133 is preferably welded inside and/or across the otherwise open second end of the beam 134 to enhance structural integrity. The first end of the beam 140 is rotatably connected to an upper end of a rocker link 140, and an opposite, lower end of the rocker link 140 is pivotally connected to the frame 110.

As described above, the resulting linkage assembly causes intermediate points along the beam 134, between the first end and the second end, to move through respective elliptical paths as the crank arms 122 (and the shaft 112) rotate through complete revolutions. The elliptical paths closer to the first end of the beam 134 (proximate the rocker link 140) have relatively smaller (vertical) minor axes, and the elliptical paths closer to the second end of the beam 134 (proximate the crank shaft 112) have relatively larger (vertical) minor axes. A seat 150 is mounted on the beam 134 and selectively movable to alternative positions along the beam 134 for movement through any of several of these elliptical paths, depending on the location of the seat 150 along the beam 134.

As shown in FIG. 1, a handlebar assembly 160, including left and right handles, is pivotally mounted on the frame 110 and linked to the rear rocker link 140. As a result, the left and right handles move through arcuate paths as the seat 150 moves through an elliptical path. The handlebar assembly 160 is omitted from FIGS. 2 and 3 for ease of illustration and more detailed focus on the subject matter of the present invention.

FIG. 4 shows the exercise apparatus 100' in a partially disassembled state and packaged as contents 103 and 104 inside respective boxes 101 and 102. The contents 103 of the box 101 include the forward frame portion 110F, the crank assembly and the forked member 132, which collectively, may be described as a front half or forward portion 111 of the exercise apparatus 100. The contents 104 of the box 102 include the rearward frame portion 110R, the rocker link 140, and the beam 134, which collectively, may be described as a rear half or rearward portion 115 of the exercise apparatus 100. Additional views of the boxes 101 and 102 and their respective contents 103 and 104 are shown in FIGS. 5-8. In all of the FIGS. 4-8, the boxes 101 and 102 are depicted as transparent and devoid of internal packing materials to better illustrate the contents 103 and 104, respectively.

FIG. 9 shows how components of the front and rear frame portions 110F and 110R align for assembly purposes. In this regard, the front frame portion 110F includes a steel rectangular tube 113 that projects in a rearward direction, and the rear frame portion 110R includes a steel U-channel member 116 that projects in a forward direction. The U-channel member 116 inserts or telescopes into the tube 113 until holes 117 in all three sides of the U-channel member 116 align with corresponding holes 114 in three corresponding sides of the tube 113.

At least one conventional bolt rigidly connects the U-channel member 116 to the tube 113. More specifically, two horizontal bolts are threaded into one set of aligned holes on a first side of the frame 110, and two horizontal bolts are threaded into another set of aligned holes on an opposite, second side of the frame 110. In addition, four vertical bolts are threaded into aligned holes on a bottom side of the frame 110 (where the U-channel member 116 and the tube 113 overlap).

Figure 10:
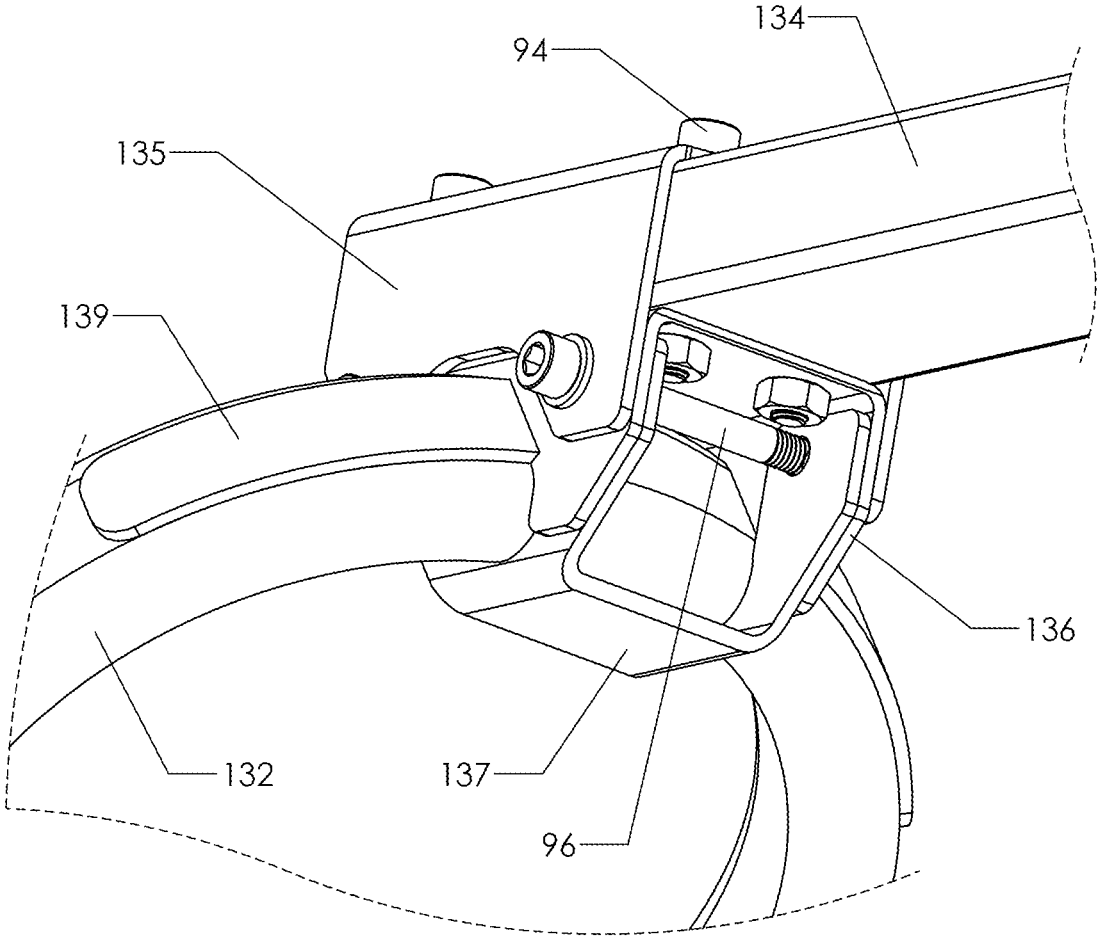
FIG. 10 is a fragmented perspective view of a second area of connection between the sub-assembly from the first box and the sub-assembly from the second box.

FIG. 10 focuses on the joint or juncture between the rear link member or beam 134 and the front link member or U-shaped member 132. As noted above, at least one bracket is interconnected between the middle segment of the U-shaped member 132 and the second end of the beam 134. On the preferred embodiment 100, three brackets 135-137 are interconnected between the U-shaped member 132 and the beam 134. All three brackets are preferably made of steel plates that have been bent into U-shaped configurations that include left and right flanges and a flat, middle plate portion. The three brackets 135-137 may alternatively be described as a bracket assembly and/or a multi-part bracket.

The bracket 136 may be described as the middle bracket, as its flanges are sandwiched between the flanges of the other two brackets 135 and 137. The flanges of the middle bracket 136 define downwardly opening notches sized and configured to match and receive respective upwardly facing segments of the middle portion of the U-shaped member 132. The flanges of the middle bracket 136 are rigidly secured to the U-shaped member 132, preferably by welding. In addition, steel strips 139 are preferably welded onto adjacent portions of the flanges and the U-shaped member 132 to provide additional reinforcement and further enhance structural integrity. The middle plate portion of the middle bracket 136 is disposed a distance above the U-shaped member 132, and defines an upwardly facing flat surface to match and receive a downwardly facing flat surface on the second end of the beam 134.

The bracket 137 may be described as the lower bracket, as its middle plate portion is disposed beneath the plate portions of the other brackets 135 and 136. The flanges of the lower bracket 137 define upwardly opening notches sized and configured to match and receive respective downwardly facing segments of the middle portion of the U-shaped member 132. The flanges of the lower bracket 137 are rigidly secured to the U-shaped member 132, preferably by welding. The middle plate portion of the lower bracket 137 is disposed a distance below the U-shaped member 132. The flanges of the lower bracket 137 are spaced just close enough together to fit between the flanges of the middle bracket 136. In one sense, the brackets 136 and 137 may be described as forming a box-like structure around the middle segment of the U-shaped member 132.

The bracket 135 may be described as the upper bracket, as its middle plate portion is disposed above the plate portions of the other brackets 136 and 137. More specifically, the middle plate portion of the upper bracket 135 defines a flat downwardly facing surface to match and rest on top of the second end of the beam 134. The flanges of the upper bracket 135 are spaced just far enough apart to receive the flanges of the middle bracket 136 therebetween.

One way to assemble the structural member 130 is to rigidly secure all the brackets 135-137 to one another and to the U-shaped member 132. In one such method, welding is preferred except that at least one conventional nut and bolt 96 and preferably two conventional nuts and bolts 96 may be used in lieu of welding the upper bracket 135 to the other brackets 136 and 137. In an alternative method, all relevant parts may be welded together, in which case the bolts 96 may be eliminated to reduce cost and/or simplify the manufacturing process. As a final assembly step, the second end of the beam member 134 is inserted into the upper bracket 135 and then rigidly secured in place via at least one conventional nut and bolt 94 and preferably four conventional nuts and bolts 94.

Yet another way to assemble the structural member 130 is to rigidly secure the brackets 136-137 to one another and to the U-shaped member 132 via welding. Similarly, the upper bracket 135 is welded to the second end of the beam 134. As a final assembly step, the second end of the beam member 134 is positioned on top of the middle bracket 136, with the flanges of the middle bracket 136 nested inside the flanges of the upper bracket 135, and then the two sub-assemblies are rigidly secured to one another via conventional nuts and bolts 94 (that extend generally vertically or perpendicular to the middle plate portions of the brackets 135-137) and conventional nuts and bolts 96 (that extend generally horizontally or perpendicular to the flanges of the brackets 135-137). The resulting juncture between the link members 132 and 134 is sufficiently strong to withstand stresses imposed during use of the exercise apparatus 100. In addition, the resulting juncture accommodates packing and shipping of the exercise apparatus 100 in separate first and second boxes 102 and 104 containing respective first and second portions 110F and 110R.

The subject invention has been described with reference to specific embodiments and particular applications with the understanding that features of the subject invention may be practiced individually and/or in various combinations and/or on various types of exercise equipment. Also, persons skilled in the art will recognize that various modifications may be made to the preferred embodiment, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of allowable claims that issue from this application or any related application.

What is claimed is:

1. A method of assembling an exercise apparatus, comprising the steps of:

providing separate front and rear portions of the exercise apparatus, wherein (a) the front portion includes (i) a front frame member configured to occupy a stable position on an underlying floor surface, (ii) a crank rotatably mounted on the front frame member, and (iii) a link having a forward end and an opposite, rearward end, wherein the forward end of the link is operatively connected to the crank, and (b) the rear portion includes (i) a rear frame member configured to occupy a stable position on an underlying floor surface, (ii) a rocker link pivotally mounted on the rear frame member, and (iii) a seat supporting beam having a rearward end and an opposite, forward end, wherein the rearward end of the beam is operatively connected to the rocker link;

rigidly connecting the front frame member to the rear frame member; and rigidly connecting the forward end of the beam to the rearward end of the link, wherein the rearward end of the link is bolted to the forward end of the beam, wherein the rearward end of the link includes a bracket that defines an upwardly facing surface, and wherein the forward end of the beam is positioned on top of the upwardly facing surface.

2. The method of 1, wherein the providing step involves removing said front and rear portions from respective first and second boxes.

3. The method of 1, wherein the first said connecting step involves bolting the front frame member to the rear frame member.

4. The method of 1, wherein the forward end of the beam includes a discrete bracket, and the second said connecting step involves inserting at least one bolt through each said bracket.

5. The method of 1, wherein said at least one bolt includes a first bolt and a second bolt, and the second said connecting step involves inserting the first bolt through vertically aligned holes in each said bracket, and inserting the second bolt through horizontally aligned holes in each said bracket.

6. The method of 1, further comprising the step of operatively mounting a seat on top of the beam.

7. A method of assembling an exercise apparatus, comprising the steps of:

providing a frame, a crank rotatably mounted on one end of the frame, a forward seat supporting member operatively connected to the crank, a rocker link pivotally mounted on an opposite end of the frame, a rearward seat supporting member having a first end operatively connected to the rocker link and an opposite, second end, and a bracket rigidly mounted on top of the forward seat supporting member to define an upwardly facing surface;

positioning the second end of the rearward seat supporting member on top of the upwardly facing surface on the bracket; and rigidly securing the second end of the rearward seat supporting member to the bracket.

8. The method of 7, wherein the rigidly securing step involves inserting a first bolt vertically through aligned vertical holes in the bracket and the second end, and inserting a second bolt horizontally through aligned horizontal holes in the bracket and the second end.

9. A method of assembling an elliptical rowing exercise apparatus, comprising the steps of:

providing a frame, a crank rotatably mounted on one end of the frame, a forked member having left and right ends rotatably connected to respective left and right sides of the crank, a rocker link pivotally mounted on an opposite end of the frame, a beam having a first end pivotally connected to the rocker link and an opposite, second end, and a bracket rigidly mounted on top of a middle portion of the forked member to define an upwardly facing surface;

positioning the second end of the beam on top of the upwardly facing surface on the bracket; and rigidly securing the second end of the beam to the bracket.

10. The method of 9, wherein the rigidly securing step involves inserting a first bolt vertically through aligned vertical holes in the bracket and the second end, and inserting a second bolt horizontally through aligned horizontal holes in the bracket and the second end.

* * * * *